US009080826B2

(12) United States Patent
Grelat et al.

(10) Patent No.: US 9,080,826 B2
(45) Date of Patent: Jul. 14, 2015

(54) TRAVERSING ARTILLERY

(71) Applicant: NEXTER SYSTEMS, Roanne Cedex (FR)

(72) Inventors: Philippe Grelat, Bourges (FR); Bertrand Remangeon, Bourges (FR); Jeremy De Souza, Bourges (FR)

(73) Assignee: NEXTER SYSTEMS, Roanne (FR)

( * ) Notice: Subject to any disclaimer, the term of this patent is extended or adjusted under 35 U.S.C. 154(b) by 0 days.

(21) Appl. No.: 14/067,337

(22) Filed: Oct. 30, 2013

(65) Prior Publication Data

US 2014/0116239 A1 May 1, 2014

(30) Foreign Application Priority Data

Oct. 31, 2012 (FR) ..... 12 02950

(51) Int. Cl.

| | |
|---|---|
| ***F41A 23/56*** | (2006.01) |
| ***F41A 27/06*** | (2006.01) |
| ***F41A 23/28*** | (2006.01) |
| ***F41A 27/22*** | (2006.01) |

(52) U.S. Cl.

CPC ..... *F41A 27/06* (2013.01); *F41A 23/28* (2013.01); *F41A 27/22* (2013.01)

(58) Field of Classification Search

CPC ..... F41A 23/28; F41A 23/56; F41A 27/22
USPC ..... 89/40.01, 40.02, 40.05, 40.07–40.09, 89/40.11, 40.15, 41.02
See application file for complete search history.

(56) References Cited

U.S. PATENT DOCUMENTS

| | | | | | |
|---|---|---|---|---|---|
| 422,003 | A * | 2/1890 | Anderson | ..... | 89/41.01 |
| 2,091,278 | A * | 8/1937 | Goebert et al. | ..... | 89/37.09 |
| 2,578,666 | A * | 12/1951 | Borden, Jr. | ..... | 89/41.02 |
| 5,048,392 | A * | 9/1991 | Ruttgerodt et al. | ..... | 89/41.02 |
| 6,886,448 | B2 * | 5/2005 | Urvoy | ..... | 89/37.07 |
| 7,798,050 | B2 * | 9/2010 | Sembtner | ..... | 89/41.15 |
| 8,109,192 | B2 * | 2/2012 | Carlson et al. | ..... | 89/37.11 |

FOREIGN PATENT DOCUMENTS

| | | |
|---|---|---|
| CH | 166 832 A | 1/1934 |
| DE | 12 94 852 B | 5/1969 |
| GB | 11502 A | 0/1911 |

OTHER PUBLICATIONS

Oct. 31, 2012 Search Report issued in French Patent Application No. FA 776505/FR 1209250 (with translation).

* cited by examiner

*Primary Examiner* — Reginald Tillman, Jr.
(74) *Attorney, Agent, or Firm* — Oliff PLC

(57) ABSTRACT

The invention relates to a movable artillery gun comprising: a frame supporting a turning plate, turning plate comprising a first pivot link of a vertical axis, turning plate comprising at least one turning motor means for rotating a turning interface around the first pivot link, the turning interface supporting a firing carriage and comprising a fine traverse laying means allowing the carriage to rotate with respect to the turning interface around a second pivot link of a vertical axis.

5 Claims, 4 Drawing Sheets

TRAVERSING ARTILLERY

The technical field of the invention is that of movable artillery guns, and particularly towed artillery guns.

A towed artillery gun comprises, on the one hand, a frame on which an artillery gun carriage rotates and comprises, on the other hand, an automotive system as well as trails. These trails play a double role. When apart and unhooked from the towing vehicle, they serve as a stable support for the firing phases. When closed, they play the role of a tiller for the towed mobility phases.

During the towed mobility phase, the gun tube is oriented parallel to the trails and toward the towing vehicle. Once the gun is on its firing site, in order to be able to fire, it is necessary to first bring the tube in the laying area located opposite to the trails, and then to accurately lay the tube of the weapon.

Heavy artillery guns which cannot be manually implemented are known, such as the 155 mm artillery guns TR155 from Nexter Systems. These guns use a single weapon rotating means consisting in a hydraulic engine and a single pivot integral with the frame for turning and laying a weapon carriage. These two phases require different performances. Turning requires speed to implement the gun as fast as possible, while laying requires accuracy. These two performances are thus difficult to maintain simultaneously as these means, which allow to act quickly, have features which do not allow to obtain a satisfactory accuracy, and vice versa.

The invention thereby proposes to solve a problem of antagonistic performances by allowing both to provide an accurate laying of the weapon carriage and the possibility to ensure a fast turning of the weapon carriage.

Thus, the invention relates to a movable artillery gun comprising:

a frame supporting a turning plate, turning plate comprising a first pivot link of a vertical axis, turning plate comprising at least one turning motor means for rotating a turning interface around the first pivot link, the turning interface supporting a firing carriage and comprising a fine traverse laying means allowing the carriage to rotate with respect to the turning interface around a second pivot link of a vertical axis.

According to an embodiment, the turning motor means comprises a pinion meshing with a ring gear of the turning interface.

Advantageously, the fine traverse laying means comprises a hydraulic cylinder able to lay the carriage over an amplitude of at least 30 degrees.

According to a feature of the invention, the turning motor means is able to rotate the plate with respect to the frame by at least half a turn.

Advantageously, the first pivot link comprises a ring protruding from the turning plate, ring corresponding with a recessed shape made in the turning interface, the ring and the recessed shape are coaxial around the vertical axis.

The invention will become more apparent upon reading the following description, with reference to the appended drawings, in which.

Figure 1:
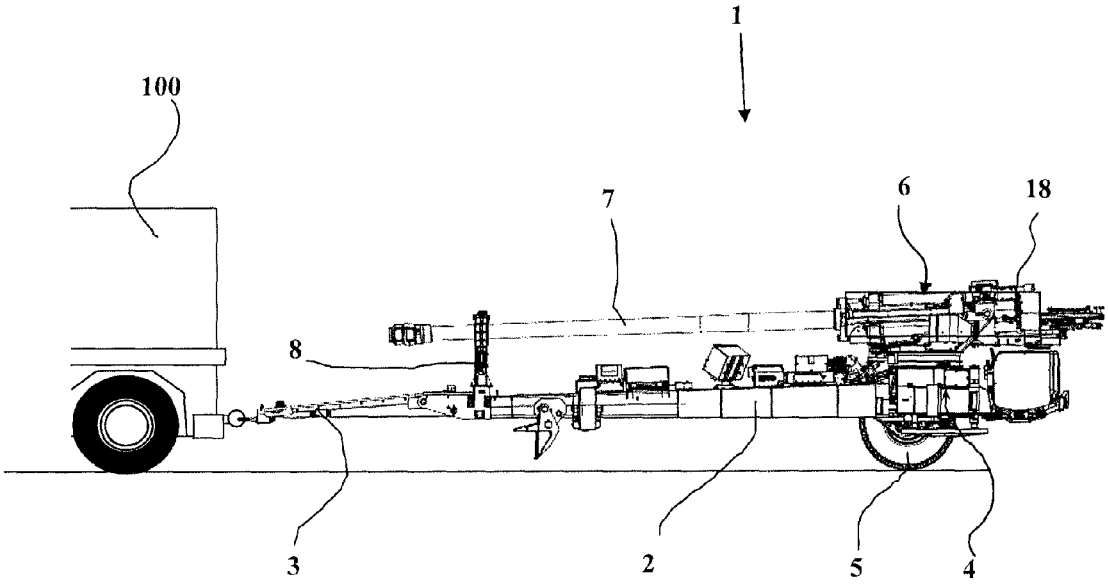
FIG. 1 shows a partial side view of an artillery gun, according to the invention, towed by a vehicle. On this view, the most forward trail as well as the wheel it carries are not shown.

According to FIG. 1, a towed artillery gun 1 is hooked behind a vehicle 100. The gun 1 is linked to the vehicle 100 by means of two trails 2 acting as tillers 3. The trails 2 are linked to a frame 4 supporting, on the one hand, an automotive system 5, allowing the mobility of the gun, and, on the other hand, a weapon 6 allowing to fire shells (shells not shown). For further reading convenience of FIGS. 1 and 3, the most forward trail has been removed from the figure as well as the wheel it carries, so as to better see the structure of the artillery gun.

The weapon comprises a tube 7 oriented toward the vehicle 100, namely oriented on the same side of the frame 4 as the trails 2. The end of the tube 7 placed toward the vehicle 100 is secured to the trails 2 by means of a clamping means 8.

Figure 2:
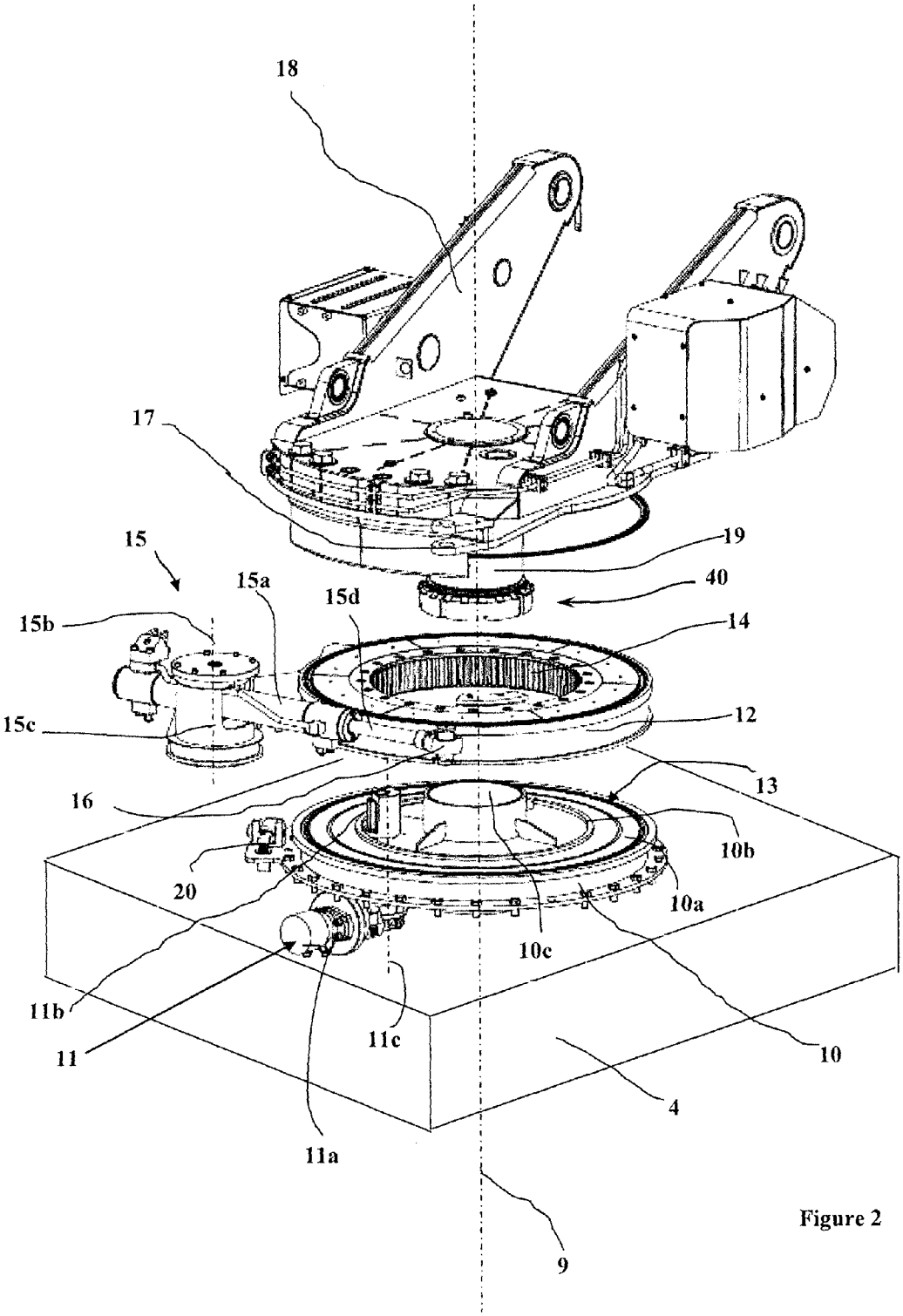
FIG. 2 shows a partial exploded view of the artillery gun according to the invention, at the frame, the view only showing the plate, the interface and the carriage.

According to FIG. 2, the frame 4 of the artillery gun 1 supports a turning plate 10 bolted to the frame 4. This plate 10 comprises a latch 20 for blocking in position a turning interface 12 described later. The turning plate 10 comprises a substantially circular upper surface 10*a*. The upper surface 10*a* comprises a pivot ring 10*b* which protrudes with respect to the upper surface 10*a*. The central part of the turning plate 10 comprises a tubular barrel 10*c* defining a cylindrical bore. The upper surface 10*a*, the pivot ring 10*b* and the tubular barrel 10*c* are coaxial around a same substantially vertical pivot axis 9.

The turning plate 10 comprises a motor means 11 comprising a hydraulic engine 11*a* driving a pinion 11*b* via a bell crank. The pinion 11*b* has a rotation axis 11*c* parallel to the pivot axis 9.

The upper surface 10*a* is designed to slidably support a turning interface 12. The turning interface 12 comprises in its lower part a groove (groove not visible) for corresponding with the pivot ring 10*b*. The pivot ring 10*b* and the groove are coaxial around the same substantially vertical pivot axis 9.

The matching between the groove and the pivot ring 10*b* thus defines a first pivot link 13 allowing the rotation of the turning interface 12 with respect to the turning plate around the axis 9. The turning interface comprises an internal tooth ring gear 14. The ring gear 14 is centered around the axis 9.

The ring gear 14 is designed to mesh with the pinion 11*b* of the motor means 11 of the turning plate 10. The rotation of the pinion 11*b* causes the turning interface 12 to rotate around the axis 9.

Thus, the motor means 11 and the gear train comprising the pinion 11*b* and the ring gear 14 will be sized by the person skilled in the art to achieve a fast rotation, namely a rotation of 180° in less than 20 seconds, namely a speed higher than 9 degrees per second.

The turning interface 12 comprises a fine laying means 15 comprising a double effect hydraulic cylinder 15*a*. The cylinder 15*a* is secured to the turning interface 12 by means of a joint 15*b* enabling low amplitude oscillations of the cylinder 15*a* around an oscillation axis 15*c* of the joint 15*b* (oscillation with an amplitude of about 15 degrees). The axis 15*c* is parallel to the pivot axis 9. The cylinder rod 15*d* comprises at its end a swivel 16 designed to be secured to a yoke 17 of a weapon carriage 18 (weapon visible in FIG. 1). The weapon carriage 18 comprises a cylindrical shaft 19 coaxial with the pivot axis 9. This shaft 19 is designed to match the bore of the tubular barrel 10*c* of the turning plate 10, the thus-constituted assembly defining a second pivot link 40 of a rotation axis 9.

The exit or the entry of the cylinder rod 15*d* of the fine laying means 15 allows to pivot the carriage 18 with respect to the turning interface 12 by about plus or minus fifteen degrees with a play lower than a tenth of a degree.

Figure 3:
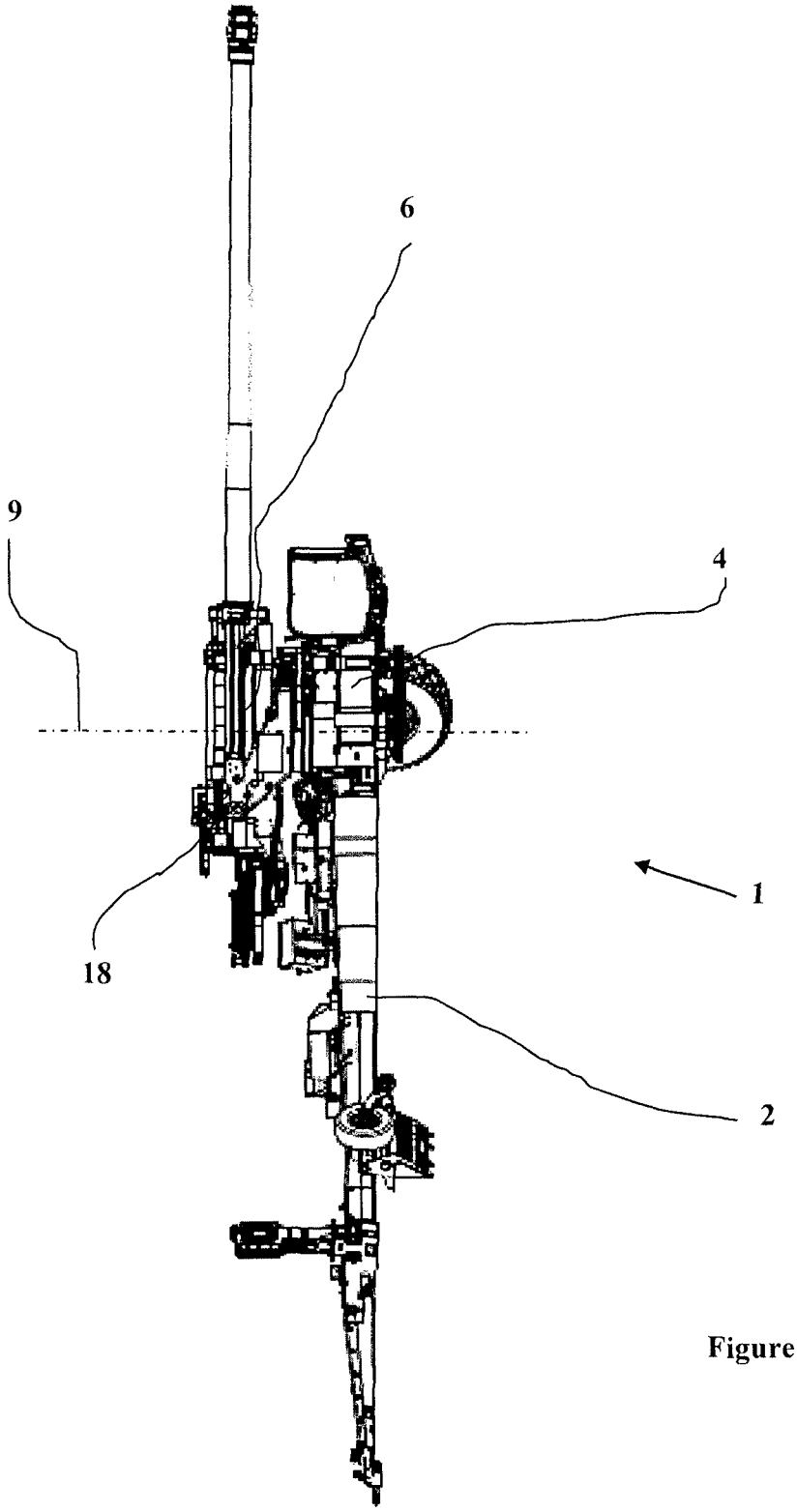
FIG. 3 shows a partial side view of the artillery gun according to the invention being turned. On this view, the most forward trail as well as its wheel are not represented.
Figure 4:
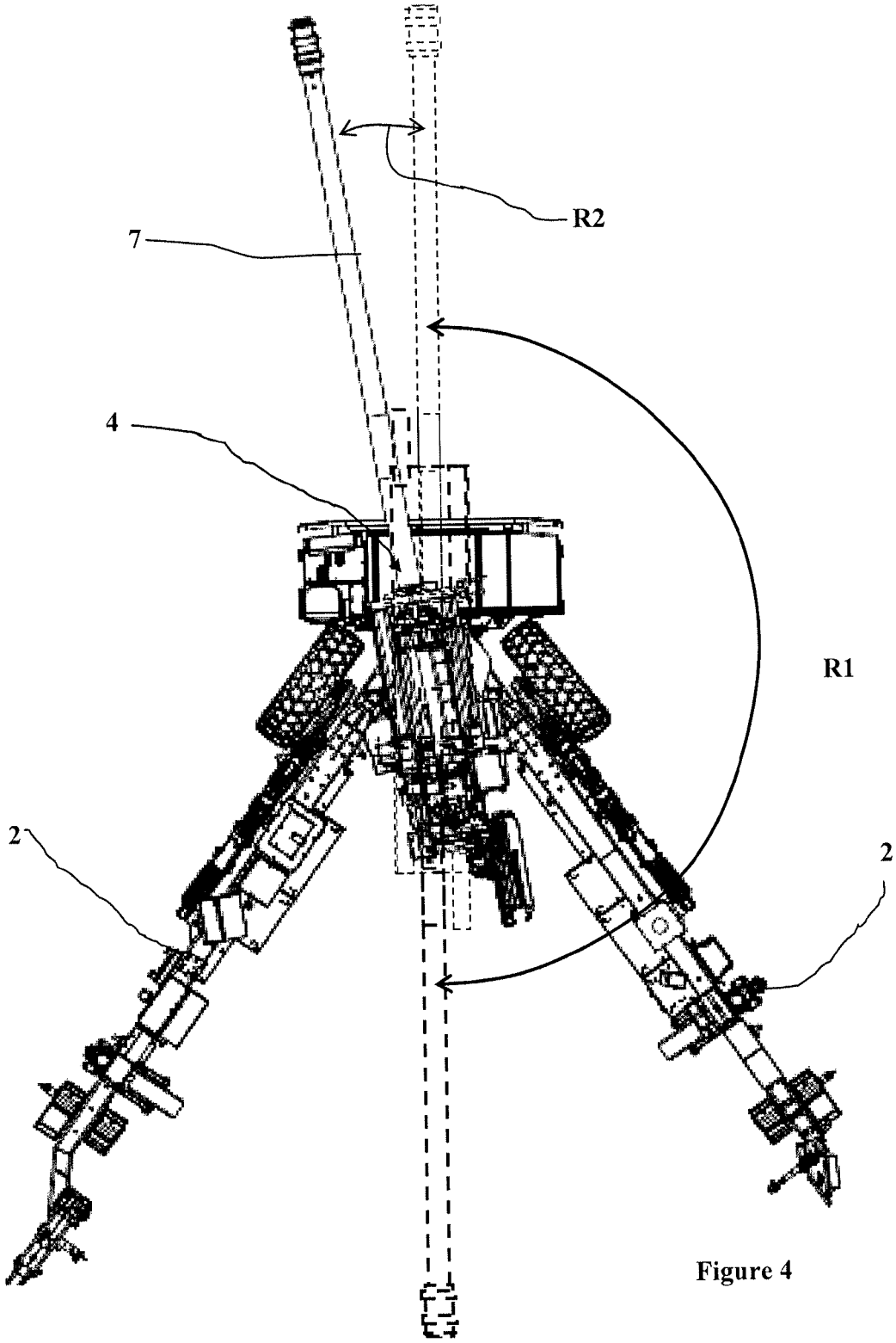
FIG. 4 shows a partial cross-sectional top view of the artillery gun according to the invention during fine laying.

According to FIG. 3, after unlocking the turning interface 12 by releasing a latch 20, the weapon 6 has rotated by half a turn around the pivot axis 9 (angle marked R1 in FIG. 4). The tube 7 of the weapon 6 is located opposite to the trails 2. To this end, the motor means 11 has driven in rotation the turning interface 12, which has rotated with respect to the turning plate 10 around the first pivot link 13. At the end of the half turn, the turning interface 12 is blocked in the reversed position via the latch 20.

In a second step, according to FIG. 4, the weapon must come back to its exact laying position so as to be aligned on a potential target (target not shown). To this end, the fine laying means has caused the rotation of the weapon carriage 18 by an angle R2 around the second pivot link 40 at a speed lower than 3 degrees per second.

Thus, the invention allows to quickly and accurately put the gun in a firing configuration. The invention also allows a fast output of the firing position, by firstly bringing the weapon back in its occupied position after the previously mentioned half turn, by means of the fine laying means, and then by bringing the weapon tube back toward the trails by means of the turning motor means 11 in a second step.

The invention claimed is:

1. A movable artillery gun comprising:

a frame supporting a turning plate, the turning plate comprising a first pivot link of a vertical axis, the turning plate comprising at least one turning motor means rotating a turning interface around the first pivot link, the turning interface supporting a firing carriage and comprising a fine traverse laying pivot device allowing the carriage to rotate with respect to the turning interface around a second pivot link of the vertical axis.

2. The artillery gun according to claim 1, wherein the turning motor means comprises a pinion meshing with a ring gear of the turning interface.

3. The artillery gun according to claim 1, wherein the fine traverse laying pivot device comprises a hydraulic cylinder able to lay the carriage over an amplitude of at least 30 degrees.

4. The artillery gun according to claim 1, wherein the turning motor means is able to rotate the turning plate with respect to the frame by at least half a turn.

5. The artillery gun according to claim 1, wherein the first pivot link comprises a ring protruding from the turning plate, the ring corresponding with a recessed shape made in the turning interface, the ring and the recessed shape are coaxial around the vertical axis.

* * * * *